US006762375B2

(12) United States Patent
Haussmann

(10) Patent No.: US 6,762,375 B2
(45) Date of Patent: Jul. 13, 2004

(54) ON/OFF SWITCHING DEVICE FOR AN ELECTRIC APPARATUS OR COMPONENT

(75) Inventor: Mathias Haussmann, Zürich (CH)

(73) Assignee: Phonak AG, Stafa (CH)

( * ) Notice: Subject to any disclaimer, the term of this patent is extended or adjusted under 35 U.S.C. 154(b) by 35 days.

(21) Appl. No.: 10/139,938

(22) Filed: May 7, 2002

(65) Prior Publication Data

US 2003/0209413 A1 Nov. 13, 2003

(51) Int. Cl.[7] ..... H01H 3/00

(52) U.S. Cl. ..... 200/52 R; 200/DIG. 2; 439/500

(58) Field of Search ..... 200/17 R, DIG. 2, 200/52 R, 61.19, 61.58 R; 439/500

(56) References Cited

U.S. PATENT DOCUMENTS 3,641,288 A * 2/1972 Lamp ..... 381/322
3,879,655 A * 4/1975 Saito ..... 200/61.62
4,598,177 A 7/1986 McGroarty et al.
5,062,138 A * 10/1991 Schmid ..... 381/322

FOREIGN PATENT DOCUMENTS

EP 0 684 749 A 11/1995

* cited by examiner

*Primary Examiner*—Renee Luebke
(74) *Attorney, Agent, or Firm*—Pearne & Gordon LLP

(57) ABSTRACT

This invention proposes an on/off switching device for a battery-powered electric or electronic apparatus or component. The apparatus or component encompasses a battery compartment (3) as well as a battery holder assembly (7, 9) by means of which the battery (11) can be rotated out of and extended from the compartment. In the extended position of the holder, the battery can be turned in and/or with the holder.

13 Claims, 3 Drawing Sheets

ON/OFF SWITCHING DEVICE FOR AN ELECTRIC APPARATUS OR COMPONENT

This invention relates to an on/off switching device for an electric apparatus or component that is powered by at least one battery, and to a method for the on/off switching of such an electric apparatus or component.

Incorporating and operating an on/off switch often poses a problem especially in the case of a miniaturized electric apparatus or of electronic micro-equipment. Therefore, given the lack of space, apparatus of that type and especially battery-powered designs are often supplied without an on/off switch, so that the power must be turned off by removing the battery from the unit. This is done for instance by opening the battery compartment, taking the battery out and storing it away from the apparatus.

Since in the case of miniaturized devices the battery is usually quite small as well, storing it becomes a near-impossibility and any handling such as its reinstallation is an extremely complicated matter. There is also a very good chance that in the process the battery is installed the wrong way.

It is therefore the objective of this invention to find a solution to the problem described above.

The proposed solution consists in mounting and retaining the battery in a rotatable battery holder which, when turned, connects or disconnects the battery poles with/from the circuit contacts, thus switching the apparatus on and off, respectively.

The battery holder is preferably so designed that, together with the battery, it can be rotated out of the battery compartment, allowing the battery to be removed and preferably also turned in the mount and to be repositioned in the compartment with the connection between its poles and the corresponding circuit contacts interrupted or reversed.

In another preferred design version the battery can be turned in, or with, the extended battery holder by about 180° so that, when the holder is rotated back into the battery compartment, the battery poles are reversed.

It is further proposed to include in the circuitry of the electric or electronic apparatus or component at least one element which permits the electric current to flow in one direction only so that, when the battery poles are reversed, no current flows through the unit. That element may for instance be a diode circuit or some other suitable element such as an integrated circuit chip.

The battery holder may be cup-shaped, for example, and so designed that when the battery is turned within the holder, it rests against at least two points on the perimeter of the cup, with protrusions provided on that perimeter to prevent the battery from falling out as it is turned. The cup is preferably made from a flexible or elastic substance such as a polymer material.

The battery holder may for instance be of a two-part design, including a flexible or elastic cup-shaped part which allows the battery to be turned, and a largely rigid, lid-shaped part to which the cup is attached and which connects in pivotable fashion to the electric apparatus via a hinge pin. This type of two-part battery holder may be produced for instance by two-component injection molding whereby both the elastic polymer material and the largely rigid polymer material are molded in one simultaneous process.

Also proposed is a method, as specified in claim 8, for the on/off switching operation of a battery-powered electric or electronic apparatus or component. According to the invention, this method is characterized in that, for switching the apparatus or component off, the battery is held in a mount which is rotated out of the battery compartment, the battery is turned about 180° while the mount is extended, and the battery is then reinserted in the battery compartment with its poles reversed.

The device according to this invention and the method for operating it lend themselves particularly well to the on/off switching of miniaturized units such as hearing aids where for reasons such as dimensional constraints it is difficult to install an on/off switch.

The following will explain this invention in more detail based on design examples and with reference to the attached drawings in which—

Figure 1:
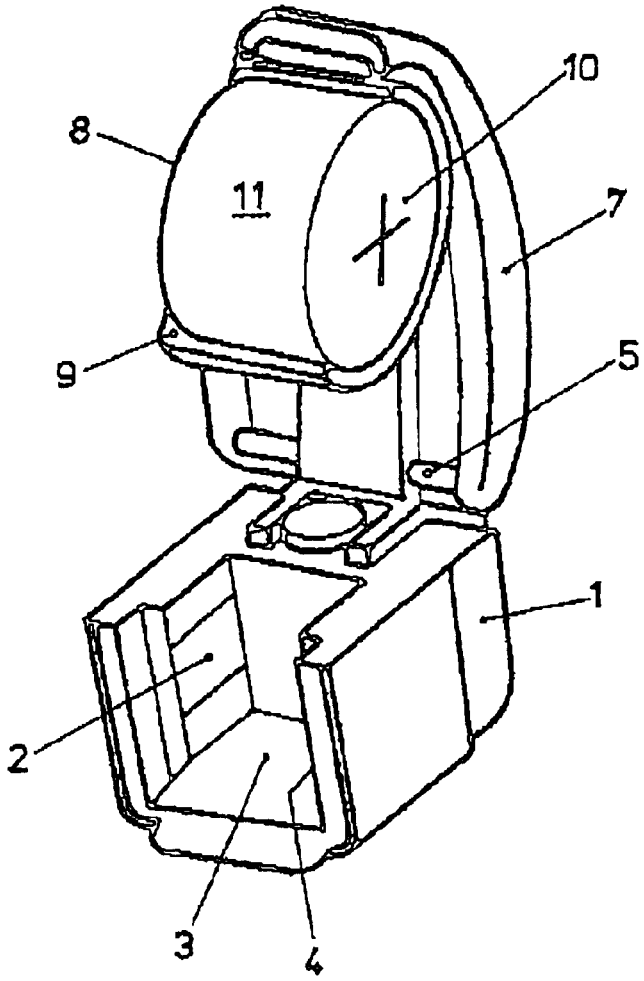
FIG. 1 is a perspective view of the battery compartment of an electric apparatus, with a battery holder rotated into the extended position.

The schematic perspective illustration in FIG. 1 shows an electric component or apparatus 1 encompassing a battery compartment 3 which features two lateral electric contacts 2 and 4 (contact 4 not visible in FIG. 1) and is designed to accommodate a battery for powering the unit 1.

In the illustration of FIG. 1, the battery 11 is retained in a cup 9 rotated into its extended i.e. open position. The retaining cup 9 on its part is attached to a bracket 7 which connects in rotatable fashion to the unit 1 by way of a hinge 5.

To switch off the unit 1, the lid-shaped bracket 7 along with the battery 11 is rotated out of the battery compartment 3 into the position depicted in FIG. 1. Thereupon the battery 11 is turned within the retaining cup 9 by 180° around its own axis, thus reversing the two poles 8 and 10. This is followed by the reinsertion of the battery 11 in the battery compartment 3, with the two battery poles now reversed which would normally cause the electric current to flow in the opposite direction. However, components are incorporated in the electric apparatus which permit the current to flow in only one direction, thus ensuring that no current can flow and the unit is switched off. To switch the unit on, the battery 11 is again rotated out of the battery compartment 3 and turned 180° around its own axis. This brings the poles 8 and 10 back into their functional position so that the unit is switched on the moment the battery 11 is reinserted into the battery compartment 3.

Figure 2:
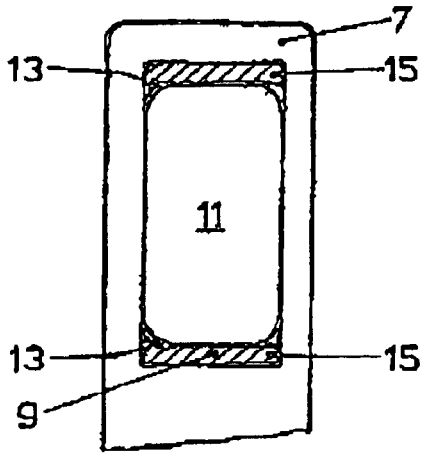
FIG. 2 is a frontal top view of the battery holder.
Figure 3:
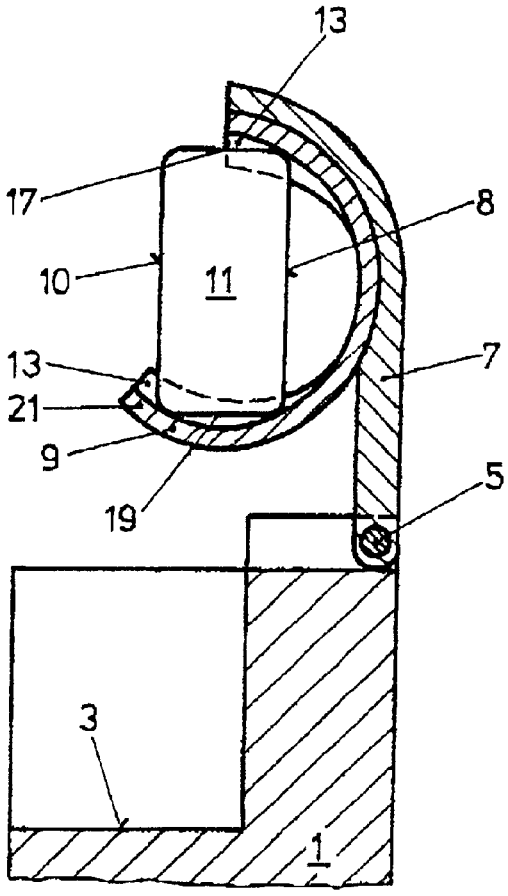
FIG. 3 is a cross-section view of the battery retaining cup as the battery is turned.

To permit easy turning of the battery 11 in the cup-shaped mount 9, the latter is preferably shaped as shown in FIGS. 2 and 3. FIG. 2, which is a frontal top view of the battery and the cup-shaped holder, clearly shows that one of the two lateral sections extends farther out than the other. The rim 13 is correspondingly larger than the rim 15.

FIG. 3 illustrates the cup-shaped holder 9 of FIG. 2 as the battery 11 is being turned. The battery pushes against the protruding upper and lower rims 13 which slightly spreads the cup 9 apart, permitting easy turning of the battery. In the process the sections 17 and 19 form a quasi axis of rotation. To prevent the battery 11 from falling out in the forward direction as it is being turned, the lower section 21 of the retaining cup 9 projects past the center of rotation 19.

Of course, the illustrations in FIGS. 2 and 3 only depict an example of how the cup-shaped holder 9 may be configured so that the battery 11 can be turned without falling out of the holder. This is important since in the case of miniaturized devices such as hearing aids it is not easy to manipulate the unit when the battery is to be turned. For example, it is essential for elderly persons with motor-function impairment to be able to turn the battery without difficulty for switching a hearing aid on or off.

Figure 4:
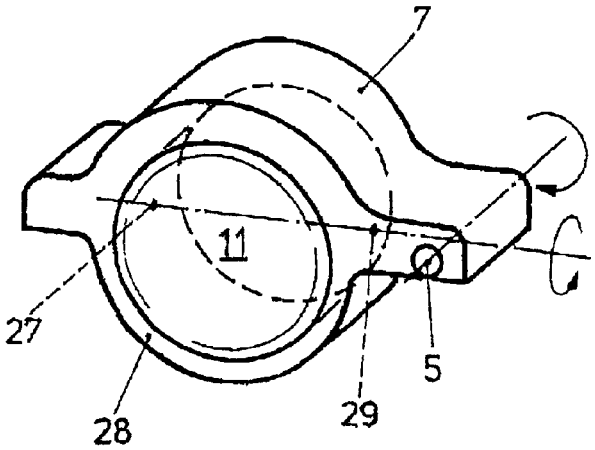
FIG. 4 shows another design variation of a retaining cup in the form of a so-called soft case.

FIG. 4 is a schematic perspective view of another design variation of the cup-shaped mount 29. In this design version as illustrated in FIG. 4, the retaining cup 29, in this case in the form of a so-called soft case, is again attached to a bracket 7 which can be rotated around a pivot 5. The "soft case" is flexible or elastic to a degree where it permits the battery 11 to be turned 180° for instance around the axis formed by the two centers of rotation 27 and 29, after which it is rotated on the pivot 5 back into the battery compartment.

Figure 5:
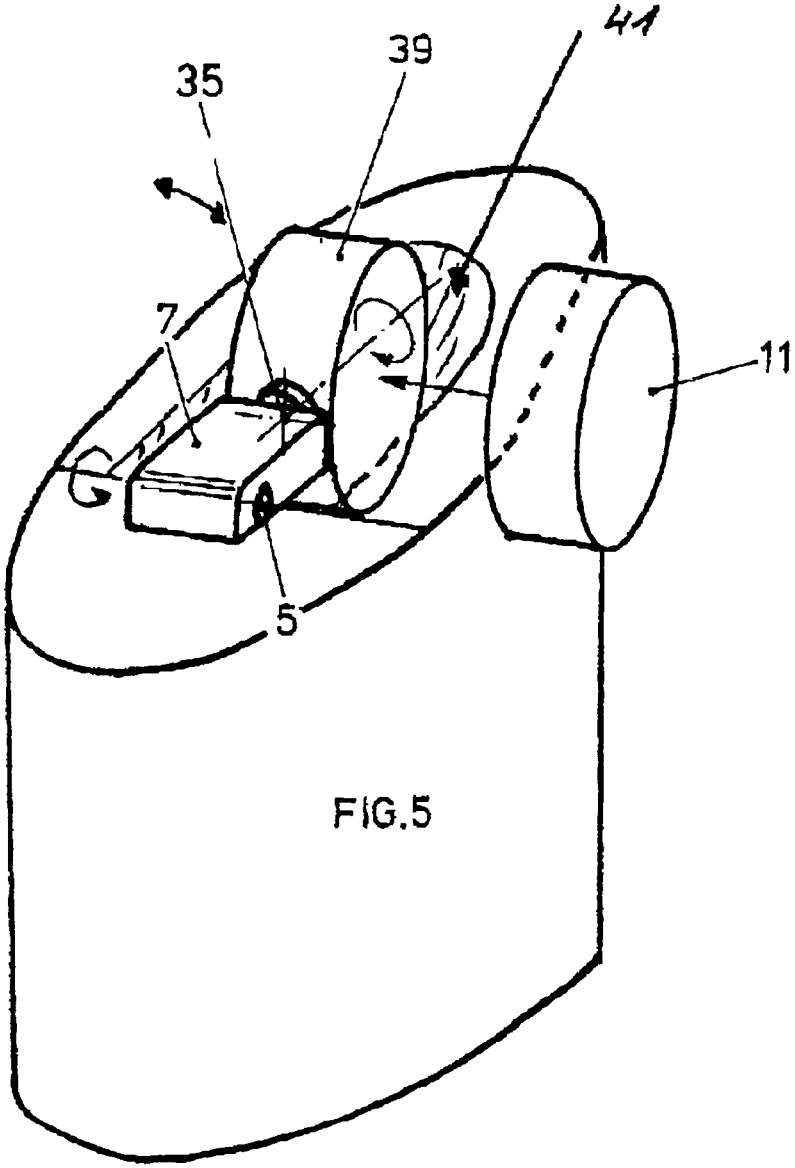
FIG. 5 illustrates yet another design version of a battery holder in which a battery can be turned.

FIG. 5 depicts another possible design variation of a retaining cup 39 for the mounting of a battery 11. In contrast to the so-called soft case 29 per FIG. 4, the retaining cup 39 consists of an essentially rigid material since there is no need for the battery, once installed in the retaining cup 39, to be turned. Instead, the retaining cup 39 which is attached to the bracket 7 and permits rotation, around the pivot 5, out of the battery compartment 41, can be rotated around another pivot 35, making a turning of the battery 11 in the retaining cup 39 unnecessary. After the battery has been turned 180° and the poles have thus been "switched", the battery can be rotated back into the battery compartment.

The essential aspect of this invention is the underlying concept whereby, according to the different solutions described above, the battery is moved out of a battery compartment of the electric apparatus and turned so as to disconnect the poles from the corresponding circuit contacts which conduct the current for the operation of the apparatus. The battery is preferably turned 180° so that in its reinserted position the poles are reversed.

As another possible solution instead of a pivotable battery holder, the battery compartment itself could conceivably be designed along the line of the so-called soft case, so that for reversing the poles the battery can be turned in the battery compartment.

The advantage of the solutions described is based on the fact that an apparatus can be switched on and off without the need for removing the battery from the unit. Moreover, when the apparatus or electric component is switched off, any unintended power consumption is prevented.

In addition, handling the small battery is made very easy and the battery can no longer be lost since it is always located in the battery compartment of the apparatus.

What is claimed is:

1. An on/off switching device for an electric or electronic battery-powered apparatus or component, characterized in that it encompasses a battery compartment as well as battery holder in which a battery can be rotated out of and extended from the battery compartment, and that in said extended position the battery can be turned in and/or with said battery holder, wherein the battery can be turned in and/or with the battery holder so that, when the battery is turned 180° and the holder is rotated back into the battery compartment, battery poles are reversed.

2. The device as in claim 1, wherein circuitry of the apparatus includes at least one element that permits an electric current to flow in only one direction so that, when the battery poles are appropriately reversed, no current flows in the apparatus.

3. The device as in claim 1, wherein the battery holder is cup-shaped or is provided with a cup-shaped attachment, said cup being pliable, flexible or elastic to a degree that permits the battery to be turned in said cup.

4. The device as in claim 1, wherein the battery holder is configured in a cup-shaped fashion wherein, when the battery is hurried in the holder, the battery rests against at least two centers of rotation and the holder is provided with protruding segments at its perimeter which prevent the battery from falling out while being turned.

5. The device as in claim 4, wherein the cup-shaped holder is made from a flexible or elastic material, in particular a polymer material.

6. The device as in claim 1, wherein the battery holder is composed of at least two pails including a flexible or elastic, cup-shaped part that permits a turning of the battery, and a largely rigid, lid-shaped pert to which the cup is attached and which rotatably connects to the electric apparatus or component via a pivot.

7. The device as in claim 6, wherein the battery holder is produced by two-component injection molding.

8. The device as in claim 1, wherein the battery holder consists of at least two parts of which a battery retainer in pivot-mounted via a hinge pin on a bracket which bracket on its part connects to the apparatus via a hinge pin, thus allowing the battery holder to be rotated out of and back into the battery compartment.

9. An on/off switching method for a battery-powered electric or electronic apparatus or component, characterized in that for switching the apparatus or component on and off, a battery is rotated out of a battery compartment, turned by 180°, and reinserted in the battery compartment with its poles reversed.

10. An on/oft switching device for a battery-powered electric or electronic apparatus or component, characterized in that a battery is retained in a battery compartment and/or in a holding bracket designed in the form of a soft case, wherein the battery can be turned within and rotated with said bracket or compartment for connecting or disconnecting the battery, by reversing battery poles so as to make or break contact.

11. The device as in claim 10, wherein the battery can be turned and/or rotated in and/or with the soft case in 180° steps so as to permit pole reversal.

12. An on/off switching device for an electric or electronic battery-powered apparatus or component, comprising:

a battery compartment; and a battery holder in which a battery can be rotated out of and extended from the battery compartment along a first axis, and that in said extended position the battery can be tamed in and/or with said battery holder along a second axis, wherein the second axis is transverse to the first axis.

13. The on/off switching device of claim 12, wherein the battery holder includes at least two points on a perimeter of the holder to mitigate the battery from falling out as it is turned along the second axis.

* * * * *

UNITED STATES PATENT AND TRADEMARK OFFICE

CERTIFICATE OF CORRECTION

PATENT NO. : 6,762,375 B2
DATED : July 13, 2004
INVENTOR(S) : Mathias Haussmann

It is certified that error appears in the above-identified patent and that said Letters Patent is hereby corrected as shown below:

Column 1,
Line 63, please delete “, as specified in claim 8,”.

Column 4,
Line 18, please delete “two pails including”, and insert therefor -- two parts including --.
Line 26, please delete “retainer in”, and insert therefor -- retainer is --.

Signed and Sealed this

Twenty-third Day of November, 2004

JON W. DUDAS
*Director of the United States Patent and Trademark Office*